US008636014B2

(12) United States Patent
Fiorio

(10) Patent No.: US 8,636,014 B2
(45) Date of Patent: Jan. 28, 2014

(54) HAIR STYLING SYSTEM

(76) Inventor: Maurice Fiorio, Toronto (CA)

( * ) Notice: Subject to any disclaimer, the term of this patent is extended or adjusted under 35 U.S.C. 154(b) by 0 days.

(21) Appl. No.: 13/506,912

(22) Filed: May 24, 2012

(65) Prior Publication Data

US 2013/0312783 A1 Nov. 28, 2013

(51) Int. Cl.
*A45D 6/02* (2006.01)

(52) U.S. Cl.
USPC ..... 132/237

(58) Field of Classification Search
USPC ..... 132/237, 223, 226, 265–267, 262, 271, 132/286, 312–315, 120, 122, 150; 15/176.1, 176.6, 145; 403/322.3, 325, 403/321, 322.1, 324
See application file for complete search history.

(56) References Cited

U.S. PATENT DOCUMENTS

| | | | | |
|---|---|---|---|---|
| 5,992,423 | A * | 11/1999 | Tevolini | 132/200 |
| 6,502,585 | B1 * | 1/2003 | Mazzei et al. | 132/237 |
| 7,424,764 | B2 * | 9/2008 | Trenz et al. | 15/210.1 |
| 2011/0094528 | A1 * | 4/2011 | Leung | 132/120 |

* cited by examiner

*Primary Examiner* — Robyn Doan
*Assistant Examiner* — Brianne Kalach
(74) *Attorney, Agent, or Firm* — Omar A. Nassif

(57) ABSTRACT

A hair styling system comprising a handle and at least one roller, and a connector for releasably securing the roller to the handle. The connector includes a sleeve slidably mounted on the handle and a compression spring for urging the sleeve axially outwardly whereby a trio of locking balls are biased radially outwardly into mating notches formed in an orifice at one end of the roller to prevent axial separation and rotation of the roller on the handle. Retraction of the sleeve on the handle releases the trio of balls from the notches for separation of the roller from the handle. The rollers are provided in a plurality of sizes and shapes and preferably are coated or formed from a ceramic ionic material.

4 Claims, 5 Drawing Sheets

HAIR STYLING SYSTEM

FIELD OF THE INVENTION

The hair styling system relates to hair styling devices and more especially to a hair styling system that provides for adding body, straightening, curling, and adding fullness to hair.

BACKGROUND OF THE INVENTION

One challenge facing hair styling is that home efforts can seldom duplicate salon results. Such failure to duplicate is quite often the result of equipment used. One problem in styling hair is the use of rollers that typically must begin having a relatively high level of heat, and left in hair until cooled. The typical approach to this problem has historically been the use of a plurality of pre-heated rollers. Again, typically, rollers are installed, allowed to cool, removed, and hair then brushed and finished with various tools. Chemical additions of sprays and other enhancements may be used at any stage.

Any reduction in these described steps results in time savings. Any improvement in the equipment used in these steps results in time savings also, as well as improved results and results that more closely mimic those achieved by a hair stylist.

Additionally, hair stylists can represent a significant cost; therefore, any hair stylist benefits that can be duplicated in personal efforts can result in significant cost savings.

A further comparison between the present system and other devices presently used, a typical roller set is designed to be used after hair is dry, to add volume, to straighten or to curl for example. Such procedure usually results in a temporary volume and curl set, followed by collapse, as the hair is not set when damp and allowed to dry in the desired condition. Hair must complete drying in a condition of curler or roller retention to accomplish desired set, the premier advantage provided by the current system. This is termed a thermal set and provides best, long lasting results. In attempts to mimic a correct thermal set, some have suggested the use of a thermal brush, which the user or stylist then attempts to leave in the hair until cooled. These efforts are prone to failure due to the brushes' extreme difficulties in staying in the hair. The handles, after all, provide great resistance to hair retention due to weight and bulk. The present system hereby provides the solutions to the above noted problems.

SUMMARY OF THE INVENTION

The general purpose of the hair styling system, described subsequently in greater detail, is to provide a hair styling system which has many novel features that result in an improved hair styling system.

To attain this, the hair styling system provides several advantages over other devices in that styling steps can be eliminated, time savings result, whether used by a professional or directly by a user on their own hair, and users also learn from the product in personal use, especially after observing a professional employ the system. The handle provides for releasable hold of the plurality of sizes and numbers of perforated tubular sleeves, which will be termed rollers. One advantage of the system is that the rollers may be provided in several material compositions, with a ceramic, ionic material being favored. The releasable locking system between handle and rollers is critical to the system's function and ergonomic ease of use.

Rollers are also provided in various shapes, such as triangular, conical, hour glass, rectangular, square and cylindrical, allowing a stylist and a user to more accurately accomplish a given hair appearance. Each roller has a plurality of perforations for providing a vented core to allow drying air to pass freely therethrough and may be provided with and without brushes. The handle may be produced in a variety of materials, including those that resist heat transfer from the rollers to the handle.

Importantly, the system provides a positive and easily used design for engagement and disengagement of rollers with the handle. Three rather than two locking balls are provided to permit the user to extend a sleeve by selectively and externally pushing outwardly on a cylindrical extension on the handle second end to engage each of the rollers and to retain the roller by means of bias of a compression spring. An easy movement of retracting the sleeve by sliding the sleeve rearwardly on the handle disengages each roller from the handle. This design provides positive engagement that prevents roller wiggle, rotation or poor fit to the handle. A concave sleeve importantly provides for a user to easily grip and slide the concave sleeve rearwardly as desired. Any number of rollers, whether with or without brushes, can be engaged in and left in hair until the desired thermal set occurs.

In its broad aspect, the hair styling system of the invention comprises a handle having a first end spaced apart from a second end; a constant diameter of the handle disposed adjacent to the second end and having a chamber disposed centrally within the handle defining a sidewall, said sidewall having a pair of diametrically-opposed slots formed therein; a compression spring disposed axially within the chamber; a sleeve slideably surrounding the constant diameter for axial reciprocal travel; a transverse bridge joined to the sleeve extending through the slots into the chamber and abutting the compression spring whereby the sleeve is biased axially outwardly; a connector attached to the bridge and depending axially outwardly; a collar connected to the end of the constant diameter at the second end, means for joining the extension to the collar; a trio of locking balls disposed circumferentially equidistant within openings in the cylindrical extension adapted to be biased radially outwardly; a shaft having a proximal end and a distal end, means at the proximal end adapted to be engaged with the connector depending from the bridge, the shaft thereby axially disposed within the chamber and the cylindrical extension, said shaft having a bulb formed at the shaft distal end; a circumferential recess formed on the bulb for receiving the balls, the bulb and circumferential recess configured to force the locking balls to a radially outward position in a one condition, and to permit the locking balls to retract to an inward position in a second condition; a roller, said roller having a cylindrical orifice disposed centrally at an end within the roller adapted to receive the handle extension therein; and an annular recess for receiving the trio of locking balls disposed within the cylindrical orifice, the annular recess having equispaced notches adapted to receive the balls therein to prevent axial separation of the roller from the handle and to prevent rotation of the roller on the handle, wherein the locking balls are configured to release the roller from the handle with an axial retracted position of the sleeve, and the locking balls are configured to retain the roller on the handle with an extended axial position of the sleeve.

A principal object of the hair styling system of the present invention is to provide a hair styling device comprised of a handle and a plurality of rollers easily detached from the handle.

Another object of the hair styling system is to save steps and time in hair styling and to achieve a long lasting set of hair in a desired style.

A further object of the hair styling system is to provide a variety of vented rollers detachably connected to a handle in order to allow a user to achieve virtually any desired result.

These together with additional objects, features and advantages of the improved hair styling system will be readily apparent to those of ordinary skill in the art upon reading the following detailed description of presently preferred, but nonetheless illustrative, embodiments of the improved hair styling system when taken in conjunction with the accompanying drawings.

BRIEF DESCRIPTION OF THE DRAWINGS

Embodiments of the process of the invention will now be described with reference to the drawings, in which.

DESCRIPTION OF THE PREFERRED EMBODIMENT

With reference now to the drawings, and in particular FIGS. 1 through 6 thereof, the principles and concepts of the hair styling system generally designated by the reference number 10 will be described.

Figure 1:
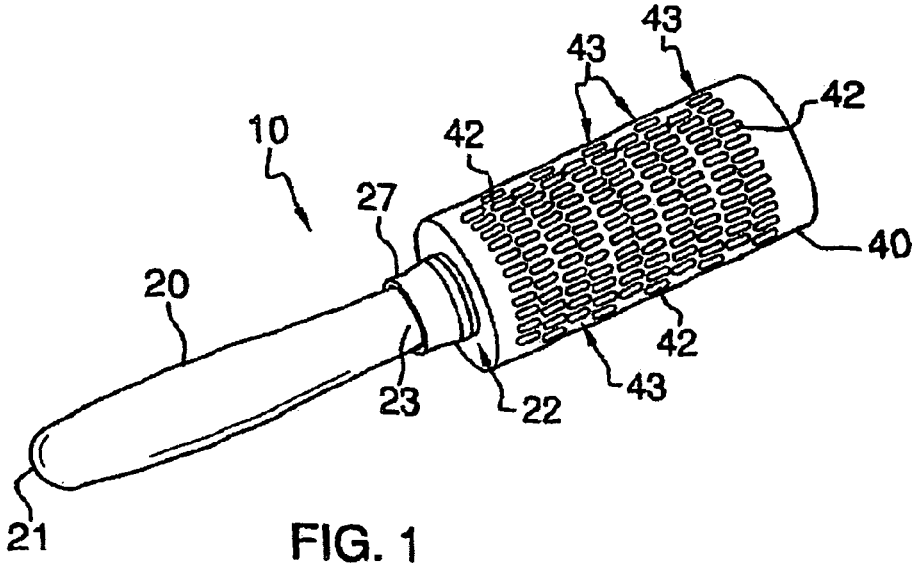
FIG. 1 is a perspective view of a cylindrical roller engaged with a handle in accordance with the present invention.
Figure 2:
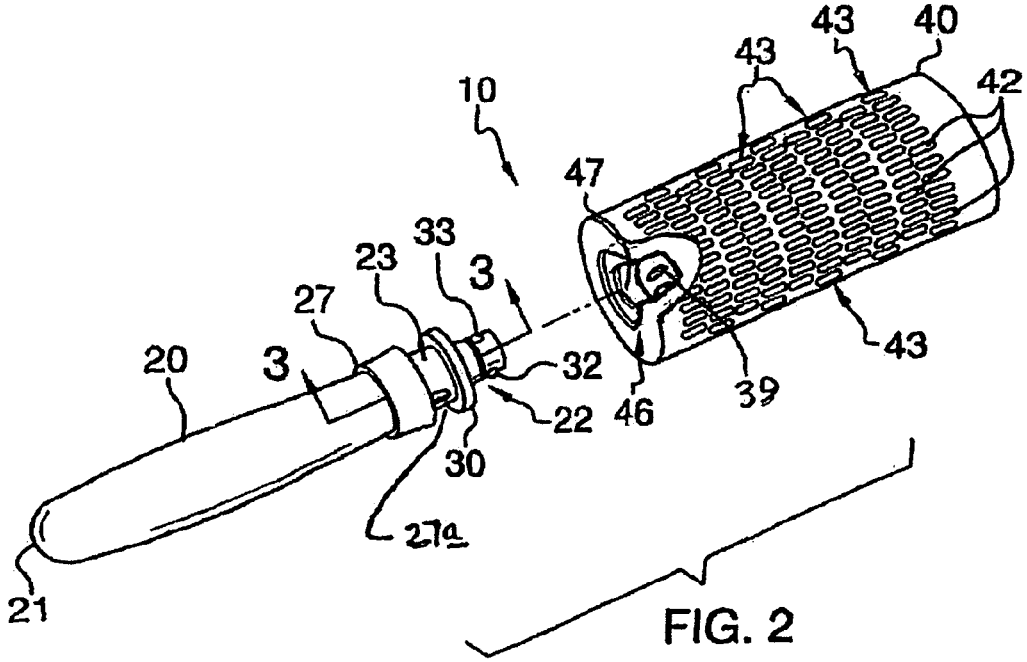
FIG. 2 is a perspective view of the embodiment of invention shown in FIG. 1, partly cut away, with the roller disengaged.

Referring to FIGS. 1 and 2, the system 10 partially comprises a handle 20 having a first end 21 spaced apart from a second distal end 22. A constant diameter section 23 is disposed adjacent to the second end 22.

Figure 3:
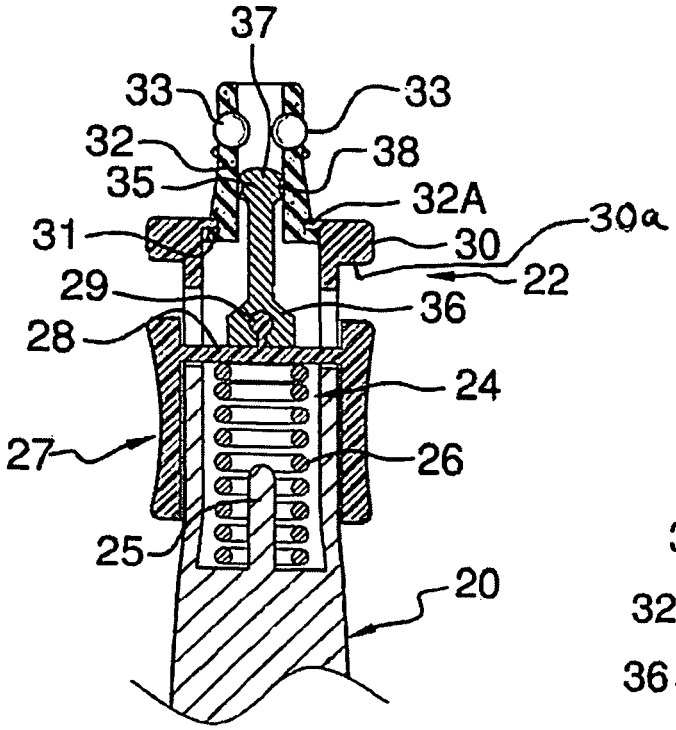
FIG. 3 is a cross sectional view taken along the line 3-3 of FIG. 2, handle in a disengagement condition.
Figure 4:
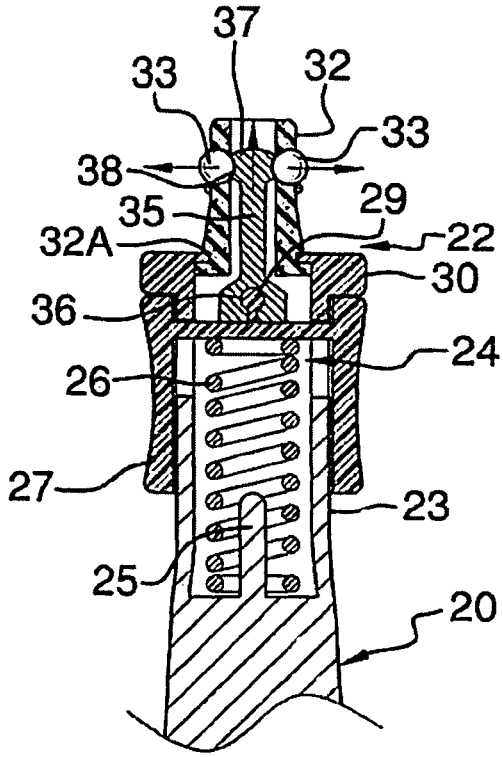
FIG. 4 is a cross sectional view of the handle shown in FIG. 3 in an engagement condition.

Referring to FIGS. 3 and 4, a cylindrical chamber 24 is disposed within the handle 20 within the constant diameter 23. An optional center post 25 may be disposed within the chamber 24 to center compression spring 26 within chamber 24. A sleeve 27, preferably concave, slideably surrounds the constant diameter 23 for reciprocal axial travel from a retracted rearward position to an extended forward position. A transversely disposed bridge or platform 28 extends from opposed sides of the sleeve 27 and passes through diametrically opposed slots 27*a* formed in the side wall of chamber 24. The platform 28 is disposed within chamber 24 in abutment with the compression spring 26 whereby platform 28 and sleeve 27 are biased axially forwardly, shown as upwardly as viewed in FIG. 4. A connector ball 29 forms part of or is attached to and extends upwardly from the platform 28.

A collar 30, connected to the free end of constant diameter 23 has a shoulder 30*a* adapted to be abutted by sleeve 27 in its extended position, as viewed in FIG. 4, to limit extended travel. An annular flange or rim 31 is disposed inwardly at the end of the collar top 30. A generally cylindrical extension 32 of nylon or stiff rubber or the like material, preferably having a tapered base at its proximal end, is affixed to the collar 30 by engagement of flange 31 in annular recess 32A at the base of extension 32 to prevent axial separation.

A trio of equispaced locking balls 33 circumferentially disposed within sockets in the distal end of the cylindrical extension 32 are shown in an inwardly, radially retracted position in FIG. 3 and in a radially outwardly extended locking position as shown in FIG. 4. A shaft or pin 35 with a ball socket 36 at its inner proximal end is frictionally engaged by the ball 29 of the platform 28. The shaft 35 is thereby disposed axially within the chamber 24 and within the cylindrical interior of extension 32 for reciprocal axial travel therein.

Referring now to FIG. 4, the bulb 37 formed on the distal end of shaft 35 has a circumferential recess or indention 38 formed on its outer surface in proximity to its end for reasons which will become apparent as the description proceeds.

Figure 6:
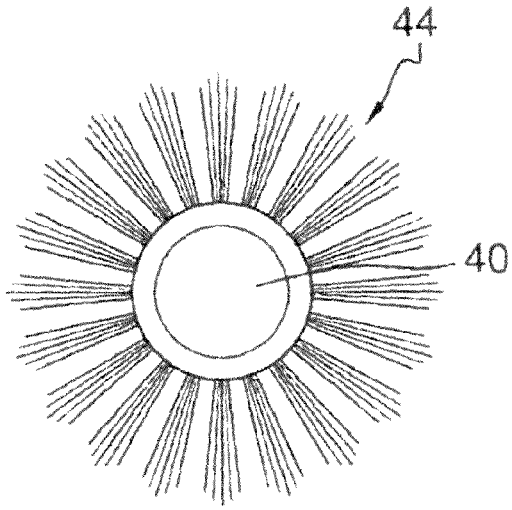
FIG. 6 is a top end view of the brush roller shown in FIG. 5.

Referring again to FIG. 2 and also to FIG. 1, a plurality of rollers 40, one of which is shown, is provided for use with handle 20. Each roller 40 has equispaced perforations 42 which are disposed annularly in a plurality of offset rows 43. The rollers 40 comprise a set of a plurality of rollers selected from a variety of shapes including triangular, conical, hour glass, rectangular, and cylindrical. Rollers 40 can be provided in different sizes. Rollers 40 are provided with and without bristles extending radially outwardly from the perforations 42, as is well known in the art, as shown in FIG. 6.

Figure 5:
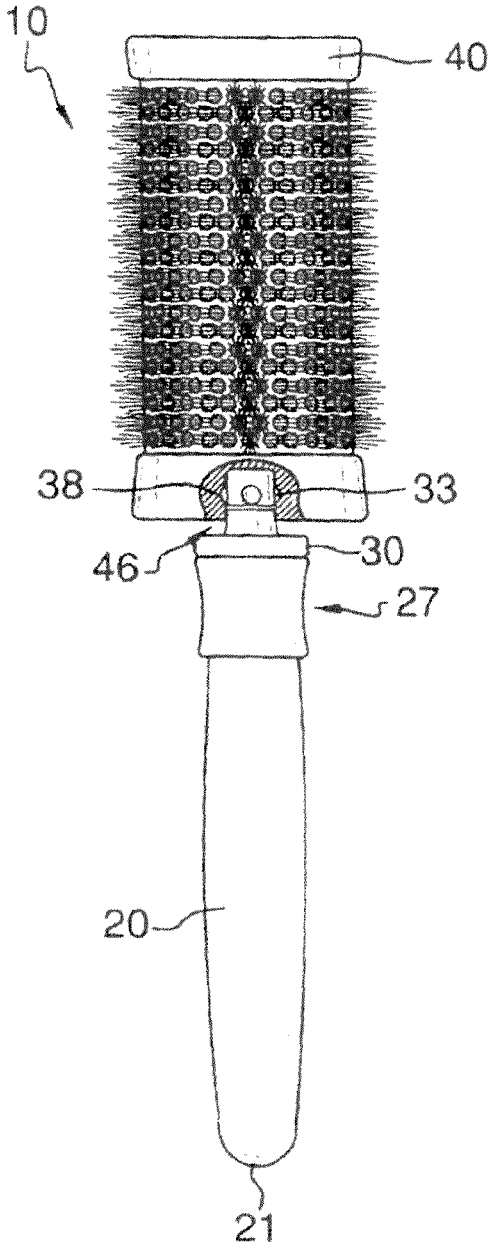
FIG. 5 is a side view, partly cut away, of the handle engaged with a cylindrical roller and brush.

Referring to FIGS. 2 and 5, orifice 46, a cylindrical is disposed centrally at one end within each roller 40 having a shape and size for mating in a close-fitting relationship preferably with a tapered entrance 47 with extension 32. Equispaced peripheral notches 39, formed in the wall of orifice 46 are adapted to receive balls 33 therein to axially lock roller 40 on handle 20 and to prevent rotation of roller 40 on handle 20.

Referring again to FIGS. 3 and 4, the bulb 37 is configured to force the locking balls 33 radially outwardly to a normally at-rest position to lock balls 33 in notches 39 under the urging of compression spring 20. Retraction of sleeve rearwardly against the bias of compression spring 24 retracts shaft 35 and bulb 37 permitting locking balls 33 to move radially inwardly and free balls 33, thereby permitting removal of handle 20 from the roller as depicted in FIG. 2.

In use, and with reference to FIG. 1 and FIG. 5, releasing sleeve 27 allows the compression spring 26 to move the shaft 35 outwardly and forces the locking balls 33 to move radially outwardly within the cylindrical extension 32, thereby locking the locking balls 33 within the ball grooves 47 of the roller 40, thereby retaining each roller 40 to the handle 20.

Referring now to FIGS. 2 and 3, retracting sleeve 27 by sliding the sleeve 27 rearwardly on the constant diameter 23 of the handle 20 allows the locking balls 33 to relax inwardly within the cylindrical extension 32. This movement thereby allows quick release of each roller 40 from the handle 20.

The handle 20 preferably is formed such as by injection moulding from a plastic such as heat-resistant polycarbonate to prevent heat transfer from the rollers, preferably in a concave ergonomic shape for a comfortable grip. Rollers 40 preferably are formed from a ceramic or a ceramic-coated metal for optimum heat transfer and rapid heating and cooling of hair treated by the system.

Figure 7:
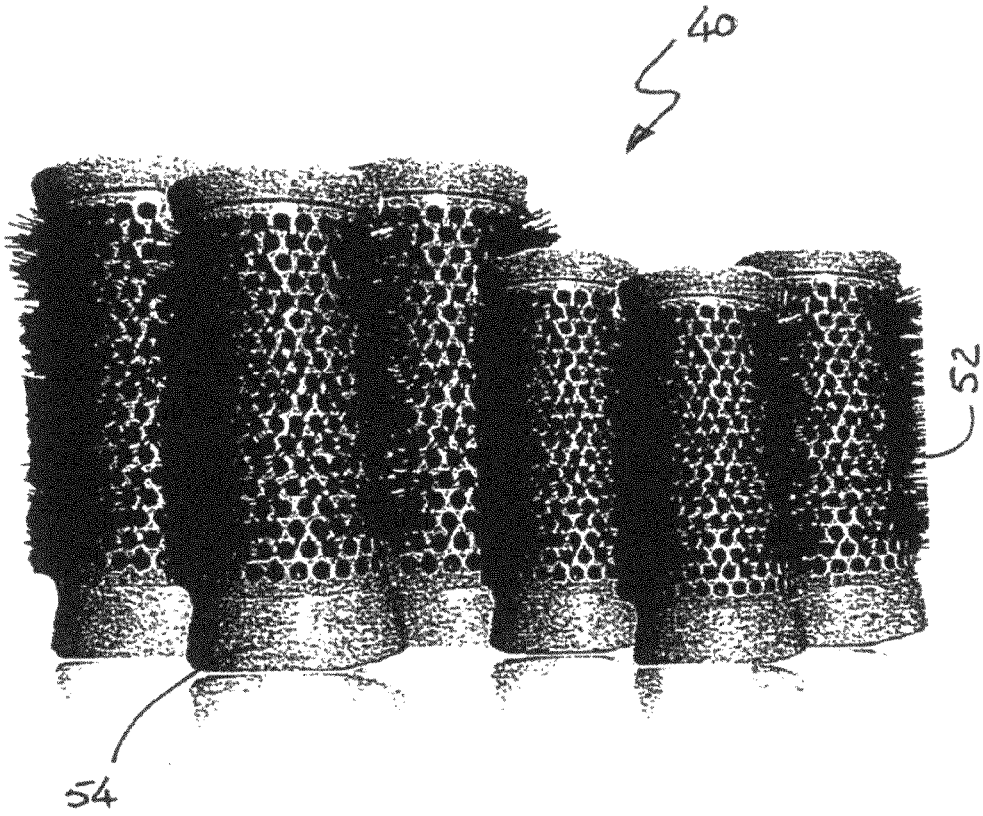
FIG. 7 is a perspective view of a set of generally cylindrical rollers.
Figure 8:
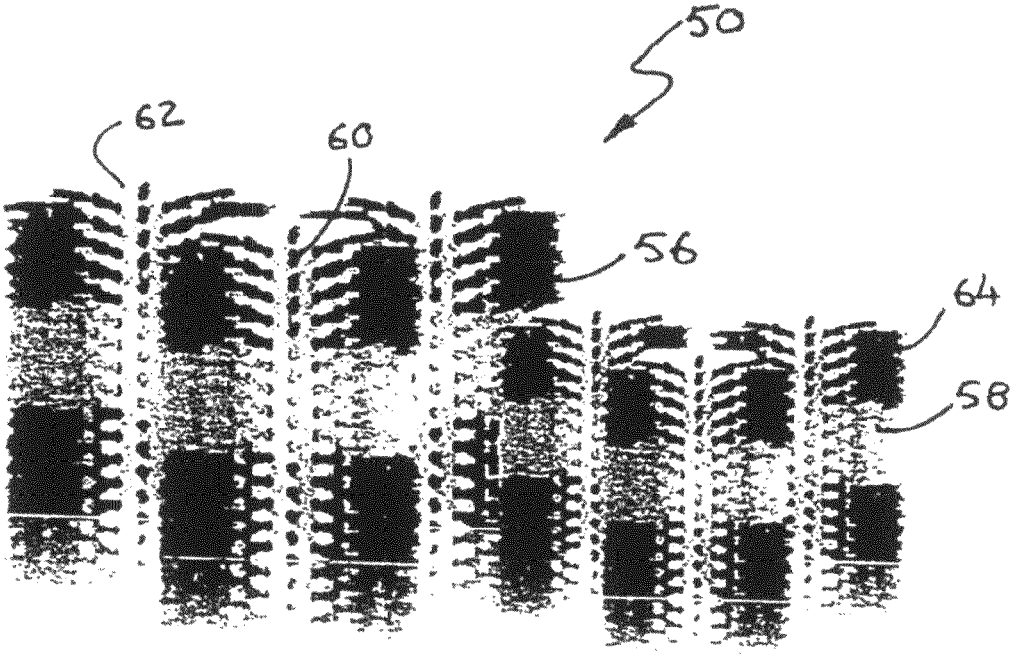
FIG. 8 is a perspective view of a set of square rollers.

FIGS. 7 and 8 illustrate two sets of embodiments of pluralities of hair rollers 40 and 50 of different sizes for use with handle 20. Rollers 40 are generally cylindrical and may be slightly concave 52 along their length, with tapered ends 54. Rollers 50 are shown with a square cross-section 56 and have bristles 58 emerging from the perforations 60 along the faces 62 and corners 64.

In use, damp hair to be curled is engaged by the bristles of a roller 40 or 50 and the handle 20 rotated to collect and roll the hair about the roller. Heat is provided by a flow of heated air from a conventional hair dryer in proximity to the roller whereby the ceramic material of the roller is quickly heated for rapid transfer of heat to dry the air. The plurality of perforations formed throughout the hair-engaging surface of the roller allows the hot air to flow into the interior of the roller and exit uniformly along its length for uniform heating and drying of the user's hair. The user then quickly detaches the roller 40 or 50 from the handle 20, leaving the roller 40 or 50 in the user's hair to complete cooling and shaping, permitting the user to select another roller 40 or 50 and continue the procedure with additional rollers of a desired size and shape.

It will be understood that other embodiments and examples of the invention will be readily apparent to a person skilled in the art, the scope and purview of the invention being defined in the appended claims.

The invention claimed is:

1. A hair styling system comprising, in combination:

a handle having a first end spaced apart from a second end;

a constant diameter of the handle disposed adjacent to the second end and having a chamber disposed centrally within the handle, defining a sidewall, said sidewall having a pair of diametrically-opposed slots formed therein;

a compression spring disposed axially within the chamber;

a sleeve slideably surrounding the constant diameter for axial reciprocal travel;

a transverse bridge joined to the sleeve extending through the slots into the chamber and abutting the compression spring whereby the sleeve is biased axially outwardly;

a ball connector forming part of or attached to the bridge and depending axially outwardly;

a collar connected to the end of the constant diameter at the second end, a generally cylindrical extension, extending outwardly from the collar, means for joining the cylindrical extension to the collar comprising a circumferential flange disposed inwardly within the collar and a mating external circumferential recess disposed at a bottom of the cylindrical extension whereby the flange of the collar engages the recess to join the cylindrical extension to the collar;

a trio of locking balls disposed circumferentially equidistant within openings in the cylindrical extension at an outer end adapted to be biased radially outwardly;

a shaft having a proximal end and a distal end, a socket formed in the shaft at the proximal end adapted to be engaged with the ball connector depending from the bridge, the shaft thereby axially disposed within the chamber and the cylindrical extension for axial reciprocal travel with the sleeve, said shaft having a bulb formed at the shaft distal end;

a circumferential recess formed on the bulb for receiving the balls, the bulb and circumferential recess configured to force the trio of locking balls to a radially outward position in a one condition, and to permit the locking balls to retract to a radially inward position in a second condition;

a roller, said roller having a cylindrical orifice with a peripheral wall disposed centrally at an end within the roller adapted to receive the handle generally cylindrical extension therein; and equispaced notches formed in the peripheral wall of the cylindrical orifice adapted to receive the balls therein to prevent axial separation of the roller from the handle and to prevent rotation of the roller on the handle, wherein the locking balls are configured to release the roller from the handle with an axial retracted position of the sleeve, and the locking balls are configured to retain the roller on the handle with an extended axial position of the sleeve.

2. The system according to claim 1 wherein each roller has a cylindrical side wall with a plurality of perforations formed therein for providing a vented core allowing air to freely pass through the roller.

3. The system according to claim 2 wherein the rollers further comprise a plurality of bristles extending radially outwardly therefrom for engaging a user's hair.

4. The system according to claim 3 wherein the rollers are formed of or coated with an ionic ceramic material.

* * * * *